US008419340B2

(12) United States Patent
Ogawa

(10) Patent No.: US 8,419,340 B2
(45) Date of Patent: Apr. 16, 2013

(54) WORKING MACHINE WITH TELESCOPIC BOOM UNIT

(75) Inventors: Junji Ogawa, Hamamatsu (JP); Noriyo Ogawa, legal representative, Hamamatsu (JP)

(73) Assignee: E-Vision Engineering Corporation, Hamamatsu-Shi, Shizuoka (JP)

( * ) Notice: Subject to any disclaimer, the term of this patent is extended or adjusted under 35 U.S.C. 154(b) by 746 days.

(21) Appl. No.: 12/517,214

(22) PCT Filed: Oct. 5, 2007

(86) PCT No.: PCT/JP2007/070020

§ 371 (c)(1),
(2), (4) Date: Feb. 1, 2010

(87) PCT Pub. No.: WO2008/068958

PCT Pub. Date: Jun. 12, 2008

(65) Prior Publication Data

US 2010/0290882 A1 Nov. 18, 2010

(30) Foreign Application Priority Data

Dec. 7, 2006 (JP) ..... 2006-330399
Dec. 15, 2006 (JP) ..... 2006-337745

(51) Int. Cl.
*B66C 23/00* (2006.01)

(52) U.S. Cl.
USPC ..... 414/728; 212/294; 212/349

(58) Field of Classification Search ..... 414/722, 414/728, 686, 718; 212/294, 349, 348
See application file for complete search history.

(56) References Cited

U.S. PATENT DOCUMENTS

| | | | | |
|---|---|---|---|---|
| 3,465,904 A * | 9/1969 | Pensa | ..... | 414/694 |
| 4,103,791 A | 8/1978 | Ullmann | ..... | 214/138 |
| 4,193,505 A * | 3/1980 | Satterberg et al. | ..... | 212/231 |

FOREIGN PATENT DOCUMENTS

| | | |
|---|---|---|
| DE | 29606337 | 6/1996 |
| JP | 08-068075 | 3/1996 |
| JP | 2003-165691 | 6/2003 |
| JP | 2004-099251 | 4/2004 |

* cited by examiner

*Primary Examiner* — Donald Underwood
(74) *Attorney, Agent, or Firm* — Bacon & Thomas, PLLC

(57) ABSTRACT

A working machine (1) includes a frame (3), a body section (2) mounted to the frame (3) for pivotal movement about a vertical axis, a boom unit (7) having a plurality of booms, including a basal boom (7*a*), telescopically extendable from and retractable to one another. A support arm (14) is mounted to the body section (2) for pivotal movement about a horizontal axis. An end of the support arm (14) is coupled with the basal boom (7*a*). The basal boom (7*a*) is pivotable relative to the support arm (14) about a horizontal axis. A first hydraulically operable device extends from the body section (2) to the basal boom (7*a*) for pivoting the basal boom (7*a*) relative to the support arm (14) about the horizontal axis.

17 Claims, 14 Drawing Sheets

WORKING MACHINE WITH TELESCOPIC BOOM UNIT

PRIORITY INFORMATION

This application is based on and claims priority to Japanese Patent Applications No. 2006-330399, filed Dec. 7, 2006, and No. 2006-337745, filed Dec. 15, 2006, the entire contents of which are hereby expressly incorporated by reference.

TECHNICAL FIELD

The present invention generally relates to a working machine, and more particularly relates to a working machine having a boom unit.

BACKGROUND ART

Working machines such as, for example, self-propelled working machines are typically used for outdoor work. For example, a self-propelled working machine collects pieces of lumber, branches, leaves, building materials, wastes, etc. at a location where they are placed and carry them to, for example, a dump truck or a place where they are used or discarded.

Such a self-propelled working machine is typically formed with a frame, a drive section, a body section and a boom unit. The drive section is mounted to the frame for propelling the working machine on the ground. The body section is mounted to the frame and is positioned thereabove. The body section has a prime mover such as, for example, an engine for powering the drive section. The boom unit extends from the body section and has an attachment to make various kinds of work such as the collecting work. The boom unit is relatively long to reach a remote place. The longer the boom unit, the larger the work area.

After finishing such work, typically, a truck transports the self-propelled working machine to a storage site from the work site. Due to the length of the boom unit, however, the boom unit can project outside the body section if the boom unit is simply laid down onto the body section. Conventionally, therefore, the boom unit is detached from the body section and separately loaded to the truck. For example, JP-A-2003-165691 and JP-A-2004-99251 disclose such a type of working machines.

Because the boom unit is relatively heavy, the detaching operation (or attaching operation) made at the work site is troublesome and extremely deteriorate the work efficiency. Particularly, if the working machine is used at a mountain side which has fewer scaffolds, the detaching (or attaching) operation can be more difficult. Normally, a small working machine thus is only available at the site, and work persons are required to do hard work manually.

DISCLOSURE OF THE INVENTION

A need therefore exists for a working machine that can have a relatively large work area and is transportable without a boom unit being detached from a body section of the working machine.

To address the need, an aspect of the present invention involves a working machine including a frame. A drive section is mounted to the frame for contacting a ground surface, rotation of a portion of the drive section enabling movement of the frame relative to the ground surface. A body section is mounted to the frame for pivotal movement generally about a vertical axis which extends generally vertically. The body section at least includes a prime mover for powering the drive section. A boom unit has a plurality of booms telescopically extendable from and retractable to one another. A support arm is mounted to the body section for pivotal movement about a first horizontal axis which extends generally horizontally. An end of the support arm is coupled with a basal boom which is one of the booms. The basal boom is pivotable relative to the support arm about a second horizontal axis which extends generally horizontally. A first hydraulically operable device extends from the body section to the basal boom for pivoting the basal boom relative to the support arm about the second horizontal axis.

In accordance with another aspect of the present invention, a working machine includes a frame. A drive section is mounted to the frame for contacting a ground surface, rotation of a portion of the drive section enabling movement of the frame relative to the ground surface. A body section is mounted to the frame for pivotal movement generally about a vertical axis which extends generally vertically. The body section at least includes a prime mover for powering the drive section. A boom unit has a plurality of booms telescopically extendable from and retractable to one another. One of the booms is a basal boom acting as a base for the telescopic movement. A guide is fixed to the basal boom and extending along a longitudinal axis of the boom unit. A bracket is movable along the guide. A support arm is mounted to the body section for pivotal movement about a first horizontal axis which extends generally horizontally. An end of the support arm is coupled with the bracket. The bracket is pivotable relative to the support arm about a second horizontal axis which extends generally horizontally. A first hydraulically operable device extends from the body section to the bracket for pivoting the bracket relative to the support arm about the second horizontal axis.

BRIEF DESCRIPTION OF THE DRAWINGS

These and other features, aspects and advantages of the present invention are now described with reference to the drawings of preferred embodiments, which are intended to illustrate and not to limit the present invention. The drawings include 15 figures in which.

DETAILED DESCRIPTION OF PREFERRED EMBODIMENTS OF THE PRESENT INVENTION

Figure 1:
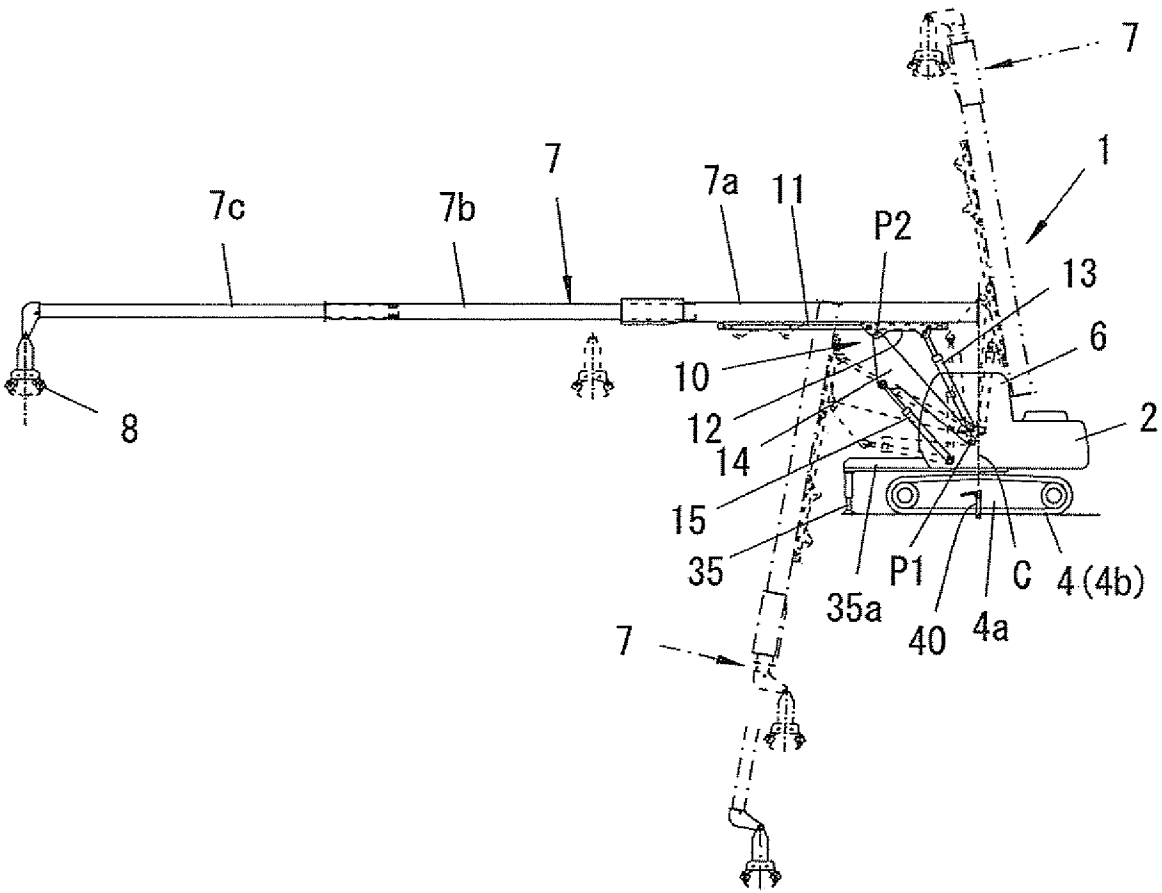
FIG. 1 illustrates a side elevational view of a self-propelled working machine configured in accordance with a preferred embodiment of the present invention, showing various operating conditions of a boom unit and other relating components of the self-propelled working machine.
Figure 2:
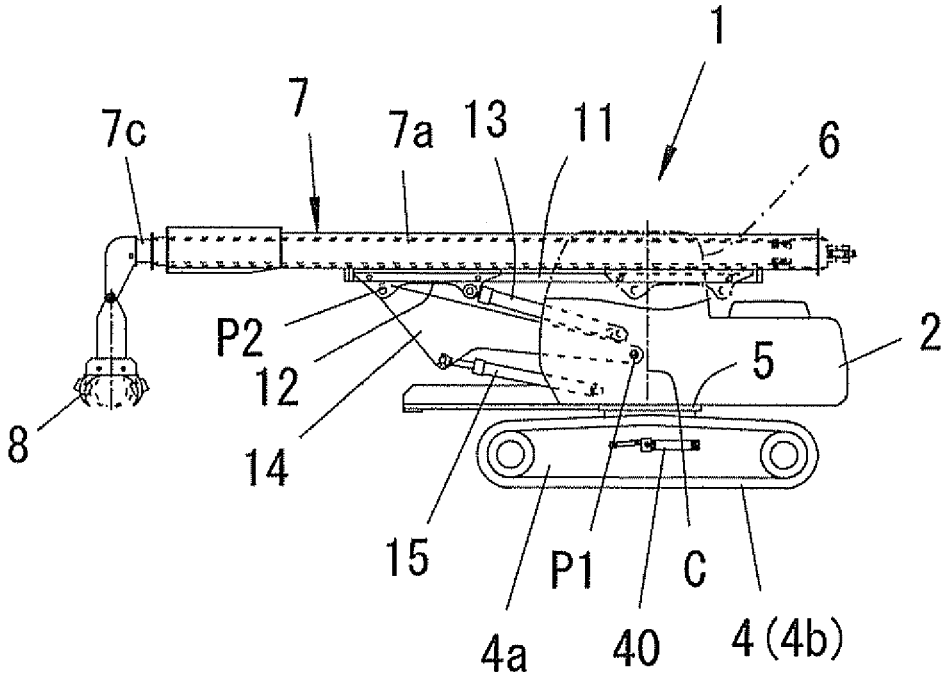
FIG. 2 illustrates another elevational view of the self-propelled working machine, showing a fully retracted condition of the boom unit and the other relating components.
Figure 3:
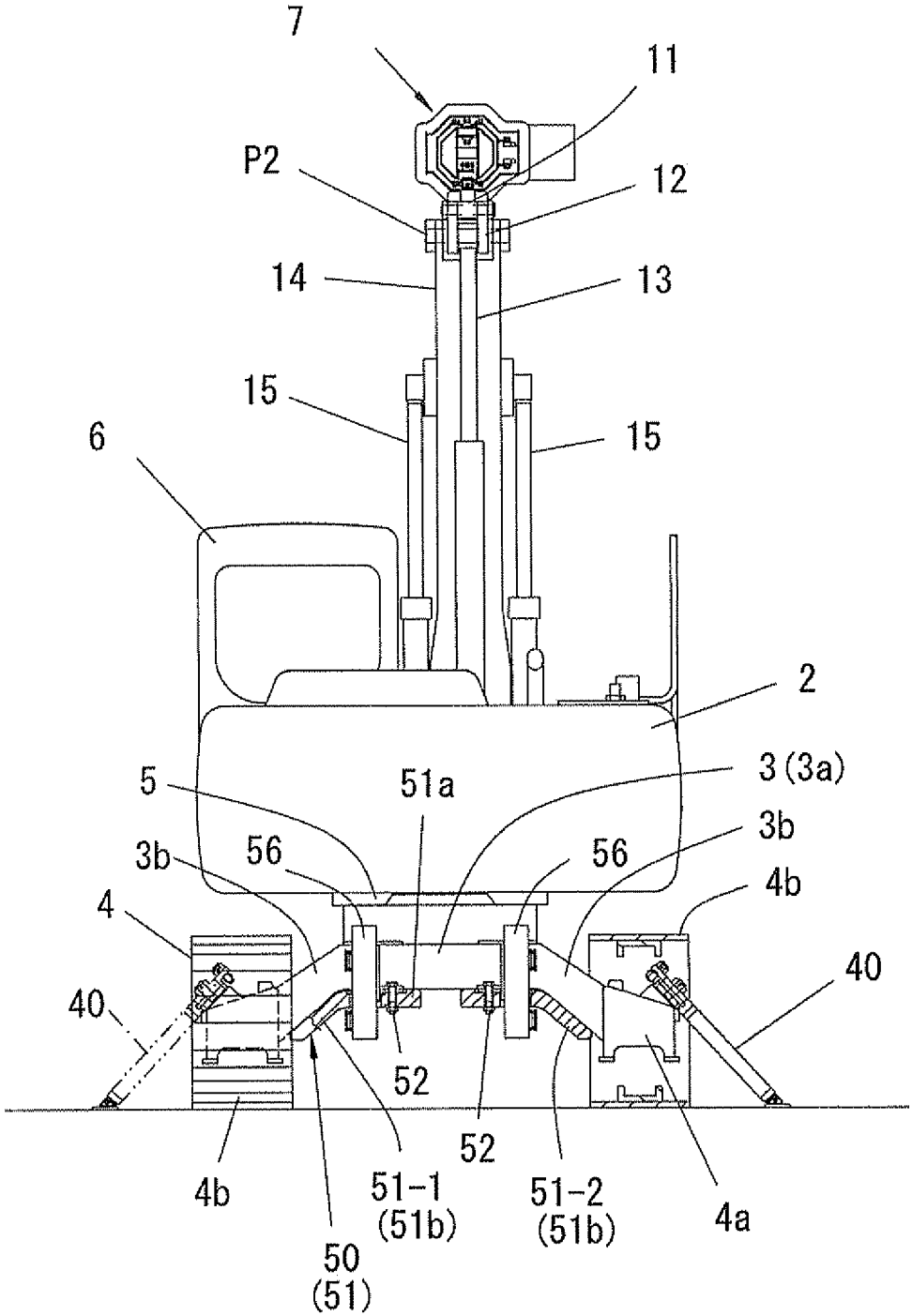
FIG. 3 illustrates a rear elevational view of an upper part of the self-propelled working machine including a machine body and a boom unit, and a front elevational view of a lower part of the self-propelled working machine including a frame and drive tracks, and showing a portion thereof in section.

With reference to FIGS. 1-3, a working machine configured in accordance with certain features, aspects and advantages of the present invention is described below.

The working machine in this embodiment is a self-propelled working machine 1. The working machine 1 includes a machine body 2, a frame 3 and drive tracks (crawlers) 4.

The drive tracks 4 function as a drive section of the working machine 1. As shown in FIG. 3, a pair of drive tracks 4 is mounted to the frame 3 for contacting a ground surface. More specifically, the frame 3 is formed with a main frame 3*a* and a pair of frame arms 3*b* extending downward outward from the main frame 3*a*. Each frame arm 3*b* is preferably bifurcated toward the drive track 4 (see FIG. 9). Each drive track 4 has a track frame 4*a* coupled with the respective frame arm 3*b*. An endless crawler shoe 4*b* is wound around the track frame 4*a*. Rotation of the drive tracks 4 enables movement of the frame 3 with the machine body 2 relative to the ground surface.

The machine body 2 functions as a body section of the working machine 1. The machine body 2 is mounted to the frame 3 via a pivot base 5 (FIG. 3) for pivotal movement generally about a vertical axis C which extends generally vertically. In this regard, it should be noted that the machine body 2 shown in FIG. 3 is pivoted 180° relative to the frame 3 so that the machine body 2 faces forward while the frame 3 and the drive tracks 4 face rearward. In this embodiment, the vertical axis C is generally centrally located in the frame 3 in a fore to aft direction of the working machine 1 (i.e., in a center of the drive track 4 as shown in FIG. 2). A prime mover is disposed in the interior of the machine body 2 for powering the drive track 4 through a transmission system. An internal combustion engine functions as the prime mover in this embodiment. The engine in this embodiment also powers hydraulically operable devices which will be described later. The machine body 2 also has other components such as, a steering device and operating devices. The operating devices are used for controlling the hydraulically operable devices.

The machine body 2 includes a cock pit 6 of the working machine 1. An operator of the working machine 1 sits on a seat in the cock pit 6 to controls the engine, steers the steering device and operates the operation devices. As shown in FIG. 3, the cock pit 6 is preferably positioned on one side of the machine body 2 in a transverse direction of the working machine 1.

As used through this description, the terms "front," "forward" and "forwardly" mean at or to the side where the operator normally sitting on the seat faces. That is, for example, the left side of FIG. 1 is the front side. The terms "rear" and "rearward" mean at or to the opposite side of the front side, unless indicated otherwise or otherwise readily apparent from the context use. That is, the right side of FIG. 1 is the rear side.

Also, as used through the description, the term "right hand side" means the side where the right hand of the operator is positioned, and the term "left hand side" means the side where the left hand of the operator is positioned. Accordingly, the cock pit 6 in this embodiment is placed on the left hand side of the machine body 2.

Further, as used in this description, the term "horizontally" means that the subject portions, members or components extend generally parallel to the ground when the working machine 1 stands normally on the ground. The term "vertically" means that portions, members or components extend generally normal to those that extend horizontally.

The machine body 2 also includes a boom unit 7 and a support arm mechanism 10 (FIG. 1) supporting the boom unit 7.

Figure 4:
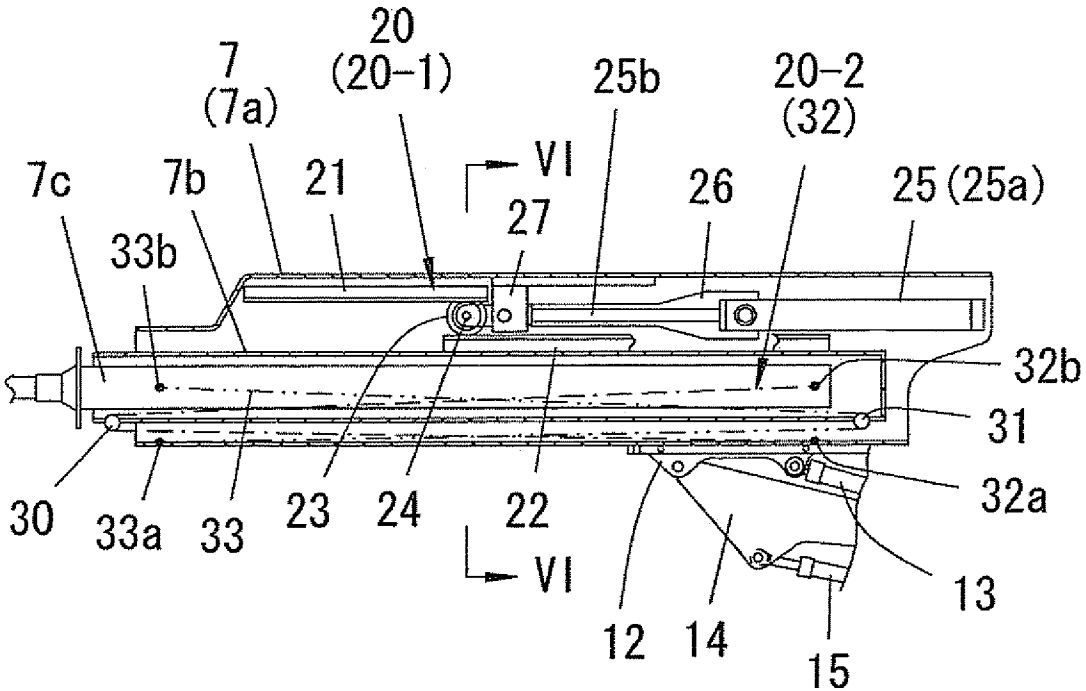
FIG. 4 illustrates a side elevational view of the boom unit that is under the fully retracted condition, other relating components being partially shown.
Figure 5:
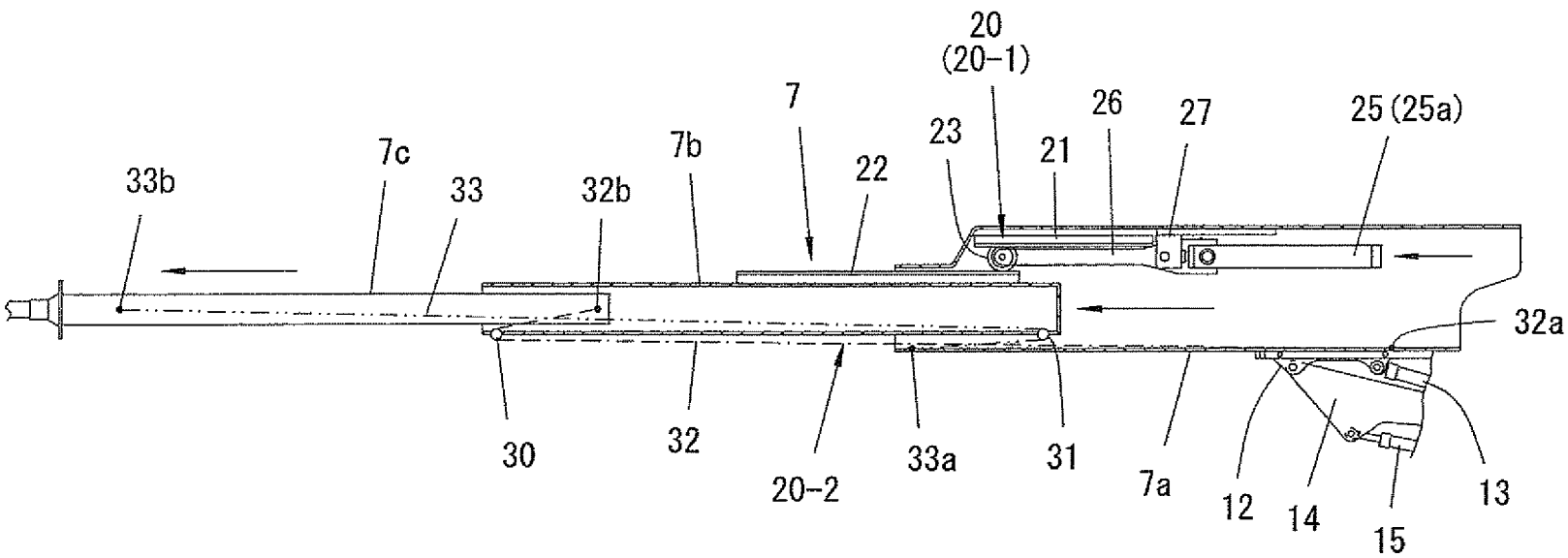
FIG. 5 illustrates a side elevational view of the boom unit that is under a fully extended condition, the other relating components being partially shown.

The boom unit 7 has a plurality of booms telescopically extendable from and retractable to one another. In this embodiment, as shown in FIGS. 4 and 5, three booms, i.e., a basal boom 7*a*, a second boom 7*b* and a third boom 7*c* are provided. Each of the booms 7*a*, 7*b*, 7*c* has a tubular shape.

The basal boom 7*a* is the thickest. The second boom 7*b* is thinner than the basal boom 7*a* but is thicker than the third boom 7*c*. The third boom 7*c* thus is the thinnest of the three. The third boom 7*c* is inserted into the second boom 7*b* to be positioned next to the second boom 7*b*. The second boom 7*b* is inserted into the basal boom 7*a* to be positioned next to the basal boom 7*a*. That is, the third boom 7*c* can be housed in the second boom 7*b* when the third boom 7*c* is fully retracted. Similarly, the second boom 7*b* can be housed in the basal boom 7*a* when the second boom 7*b* is fully retracted. The support mechanism 10 directly supports the basal boom 7*a*. A drive mechanism 20, which will be described later, can extend or retract the booms 7*a*, 7*b*, 7*c* of the boom unit 7*a*.

In this embodiment, an attachment such as, for example, a clamshell bucket 8 (FIG. 1) is detachably attached to an end of the third boom 7*c* for collecting pieces of wood, branches and leaves. An actuating mechanism (not shown) actuates the clamshell bucket 8.

The support arm mechanism 10 is mounted to the machine body 2 to support the boom unit 7 generally above the machine body 2. With reference to FIGS. 1-3, the support arm mechanism 10 preferably includes a guide rail 11, a boom bracket 12, a boom pivoting cylinder device 13, a support arm 14 and a support arm pivoting cylinder device 15.

The guide rail 11 extends on a bottom surface of the basal boom 7*a* along a longitudinal axis of the basal boom 7*a* which extends in the fore to aft direction of the working machine 1. The guide rail 11 is unitarily formed with the basal boom 7*a*. Alternatively, the guide rail 11 can be made separately from the basal boom 7*a* and can be detachably attached to the basal boom 7*a*.

The boom bracket 12 is made of steel. The boom bracket 12 engages with the guide rail 11 to be movable along the guide rail 11. The boom bracket 12 is elongated to extend along the longitudinal axis of the basal boom 7*a*. The boom bracket 12, however, is shorter than the guide rail 11. Preferably, the boom bracket 12 can be coupled with the guide rail 11 in a rear location and in a front location of the guide rail 11. In this embodiment, the guide rail 11 has two bolt holes in the rear location and also has two bolt holes in the front location. The rear set of the bolt holes are spaced apart from each other, while the front set of the bolt holes are spaced apart from each other. Spans between the bolt holes of one set are the same as those of another set.

As indicated by the actual line of FIG. 1, the boom bracket 12 is preferably coupled with the guide rail 11 in the rear location by bolts when the working machine 1 is under a work condition. The basal boom 7*a* thus can protrude forwardly. Meanwhile, as indicated by the actual line of FIG. 2, the boom bracket 12 is preferably coupled with the guide rail 11 by bolts in the front location when the working machine 1 is under a transported condition by a truck or the like. In this state, the basal boom 7*a* does not protrude forwardly. In other words, the basal boom 7*a* overlaps the machine body 2 in a top plan view in this state more than in the former state.

The support arm 14 is a rigid member which is relatively narrow in a rear view (FIG. 3) and generally has a reversed triangle shape in a side view (FIGS. 1 and 2). Preferably, the support arm 14 is made of steel. The support arm 14 is generally positioned in the center of the machine body 2 in the rear view. That is, the support arm 14 is located on the right hand side of the cockpit 6 in the rear view. Because the boom unit 7 is supported by the support arm 14, the boom unit 7 is also located in the center of the machine body 2 in the rear view and on the right hand side of the cockpit 6.

As shown in FIG. 2, a rear end of the support arm 14 is positioned slightly in front of the vertical axis C of the working machine 1. The rear end of the support arm 14, i.e., a first apex of the triangular shape, is coupled with the machine body 2 via a lower pivot pin P1 for pivotal movement about an axis of the lower pivot pin P1 extending horizontally in the transverse direction of the working machine 1. On the other hand, a front end of the support arm 14, i.e., a second apex of the triangular shape, is coupled with the boom bracket 12 via an upper pivot pin P2 for pivotal movement about an axis of the upper pivot pin P2 extending horizontally in the transverse direction of the working machine 1. The support arm 14 thus is pivotable in a vertical direction. The upper pivot pin P2 is located at a mid portion of the basal boom 7*a* in the longitudinal direction of the basal boom 7*a*. In other words, a rear end of the basal boom 7*a* is located in the rear of the upper pivot pin P2.

As shown in FIG. 1, a length of the support arm 14 along the longitudinal axis of the basal boom 7*a*, i.e., a distance generally between the axis of the pivot pin P1 and the axis of the pivot pin P2, is decided so that the boom bracket 12 is positioned above a front end of the machine body (slightly above the cockpit 6 in this embodiment) when the support arm 14 is pivoted upwardly about the lower pivot pin P1 and also that the boom bracket 12 is positioned slightly in front of the machine body when the support arm 14 is pivoted downwardly about the lower pivot pin P1.

The boom pivoting cylinder device 13 and the support arm pivoting cylinder device 15 are the hydraulically operable devices. The hydraulically operable device is typically formed with a cylinder, a piston and a piston rod. The piston is reciprocally movable within the cylinder. One end of the piston rod is fixed to the piston within the cylinder and the other end of the rod extends outside beyond one end of the cylinder. The other end of the cylinder is closed. Working fluid such as, for example, oil is enclosed in the interior of the cylinder. When the working fluid is supplied to a fluid chamber defined opposite to the piston rod within the cylinder, the fluid pushes the rod to extend out of the cylinder. When, on the other hand, the working fluid is supplied to another fluid chamber through which the piston rod extends, the piston rod is retracted into the cylinder.

As shown in FIGS. 1 and 2, the closed end of the cylinder of the boom pivoting cylinder device 13 is coupled with the machine body 2 via a lower pivot pin for pivotal movement about an axis of the pivot pin extending horizontally in the transverse direction of the working machine 1. The lower pivot pin of the boom pivoting cylinder device 13 is preferably positioned adjacent to the lower pivot pin P1 of the support arm 14 and slightly above the lower pivot pin P1. A distal end of the piston rod of the boom pivoting cylinder device 13 is coupled with the boom bracket 12 via an upper pivot pin for pivotal movement about an axis of the pivot pin extending horizontally in the transverse direction of the working machine 1. The upper pivot pin of the piston rod is positioned in the rear of the upper pivot pin P2 and is spaced apart from the upper pivot pin P2. Consequently, the boom pivoting cylinder device 13 is positioned generally above the support arm 14.

Similarly, the closed end of the cylinder of the support arm pivoting cylinder device 15 is coupled with the machine body 2 via a lower pivot pin for pivotal movement about an axis of the pivot pin extending horizontally in the transverse direction of the working machine 1. The lower pivot pin of the support arm pivoting cylinder device 15 is preferably positioned below the lower pivot pin P1 of the support arm 14. A distal end of the piston rod of the support arm pivoting cylinder device 15 is coupled with the support arm 14 at a third apex thereof via an upper pivot pin for pivotal movement about an axis of the pivot pin extending horizontally in the transverse direction of the working machine 1. Consequently, the support arm pivoting cylinder device 15 is positioned generally below the support arm 14.

When the piston rod of the boom pivoting cylinder device 13 is extended or retracted, the basal boom 7*a* pivots about the axis of the upper pivot pin P2. Meanwhile, when the piston rod of the support arm pivoting cylinder device 15 is extended or retracted, the support arm 14 pivots about the axis of the lower pivot pin P1. As shown in FIG. 2, when the boom bracket 12 is positioned in the front location and both of the piston rods of the respective cylinder devices 13, 15 are fully retracted, the support arm 14 slants fully forward and the basal boom 7*a* extends horizontally. The entire height of the working machine 1 is relatively low under this condition to result in the higher portability of the working machine 1.

Although not shown, a hydraulic system is disposed in the machine body 2. The hydraulic system includes a hydraulic pump which is directly powered by the engine or powered by an electric motor which is driven by the engine. The boom pivoting cylinder device 13 and the support arm pivoting cylinder device 15 are connected to the hydraulic pump through hydraulic conduits. Therefore, the boom pivoting cylinder device 13 and support arm pivoting cylinder device 15 both can be operated by the hydraulic pump.

Reference numeral 35 of FIG. 1 indicates a front occasional leg depending from a slidable plate 35*a* to receive a load of a front part of the working machine 1. Preferably, a pair of occasional legs on both of the lateral sides of the working machine 1 can effectively support the front part of the working machine 1. Also, reference numeral 40 of FIGS. 1-3 indicates one of side occasional legs pivotally attached to the frame 3. The side occasional legs 40 will be described in detail later.

Figure 6:
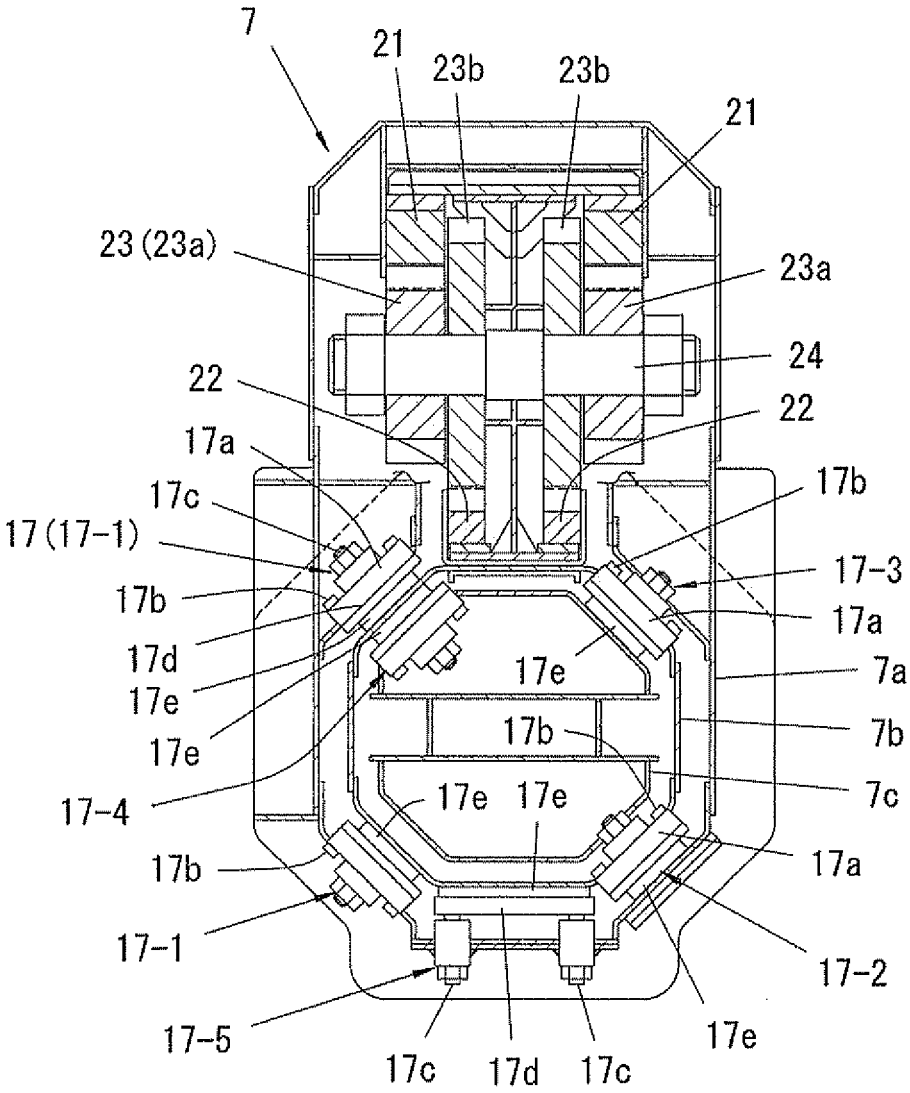
FIG. 6 illustrates an enlarged cross-sectional view of the boom unit taken along the line VI-VI of FIG. 4.

With reference to FIGS. 4-6, the boom unit 7 is described in greater detail below.

Preferably, as shown in FIG. 6, each boom 7*a*, 7*b*, 7*c* generally has an octagonal shape in section. More specifically, each boom 7*a*, 7*b*, 7*c* has a top side, a bottom side, a right side, a left side, a top and right corner, a bottom and right corner, a bottom and left corner and a top and left corner. The top and bottom sides extend generally horizontally in the transverse direction of the working machine 1. The right and left sides extend generally vertically on the right and left hand sides of the top and bottom sides. The top and right corner is interposed between the top side and the right side and inclines 45° relative to both of the sides. The bottom and right corner is interposed between the bottom side and the right side and inclines 45° relative to both of the sides. The bottom and left corner is interposed between the bottom side and the left side and inclines 45° relative to both of the sides. The top and left corner is interposed between the top side and the left side and inclines 45° relative to both of the sides.

The octagonal shape of each boom 7*a*, 7*b*, 7*c* can be formed with a single metallic material. In this embodiment, however, multiple metal pieces are united with each other to form the octagonal shape. Preferably, the respective pieces are welded to one another.

A boom smaller than another one is inserted into the larger one for slide movement. For example, the second boom 7*b* is inserted into the basal boom 7*a* with four outer side surfaces and four outer corners of the second boom 7*b* facing four inner side surfaces and four corner surfaces of the basal boom 7*a* which correspond to those of the second boom 7*b*.

Four shoe units form a set of shoe units 17 (17-1, 17-2, 17-3, 17-4) for reducing friction. For example, four shoe units 17-1 are circumferentially disposed at four corners of the basal boom 7*a*, although only two of them disposed at the bottom and left corner and at the top and left corner are indicated in FIG. 6. That is, other two shoe units 17-1 are omitted in FIG. 6. Similarly, one of four shoe units 17-2 circumferentially disposed at four corners of the second boom 7*a* is only indicated and other three shoe units 17-2 are omitted. Also, one of four shoe units 17-3 circumferentially disposed at four corners of the second boom 7*b* is only indicated and other three shoe units 17-3 are omitted. Further, one of shoe units 17-4 circumferentially disposed at four corners of the third boom 7*c* is indicated and other three shoe units 17-4 are omitted. Additionally, both sets of the shoe units 17-2 and the shoe units 17-3 are attached to the second boom 7*a*. However, as discussed below, the set of the shoe units 17-2 face the inner corner surfaces of the basal boom 7*a* and the set of the shoe units 17-3 face the outer corner surfaces.

Although the shoe units 17-1, 17-2, 17-3, 17-4 are all indicated in the cross-section of FIG. 6, the respective sets of the shoe units 17-1, 17-2, 17-3, 17-4 are actually disposed at different positions in the longitudinal direction of the boom unit 7. With reference to FIG. 5, the set of the shoe units 17-1 is disposed at a forward end of the basal boom 7*a*. The set of the shoe units 17-2 is disposed at a rear end of the second boom 7*b*. The set of the shoe units 17-3 is disposed at a forward end of the second boom 7*b*. The set of the shoe units 17-4 is disposed at a forward end of the third boom 7*c*.

With reference to FIG. 6, the respective shoe units 17 (17-1, 17-2, 17-3, 17-4) generally have the same structure. That is, each shoe unit 17 is formed with an attaching metal member 17*a*, small bolts 17*b*, an adjusting bolt 17*c*, a shoe holder 17*d* and a shoe 17*e*. Because of having the same structure, the structure of the shoe unit 17-1 on the top and left corner of the basal boom 7*a* will be described below as an example.

The corner of the basal boom 7*a* has an aperture through which the adjusting bolt 17*c* passes. Also, the metal member 17*a* has an aperture through which the adjusting bolt 17*c* passes. The aperture of the corner of the basal boom 7*a* is slightly larger than the aperture of the metal member 17*a*. The metal member 17*a* has a female thread inside thereof. The metal member 17*a* is fastened to the corner of the basal boom 7*a* by the small bolts 17*b*. The adjusting bolt 17*c* is screwed into the metal member 17*a*. The shoe 17*e* is coupled with the shoe holder 17*d*. The shoe holder 17*d* with the shoe 17*e* is positioned between an end of the adjusting bolt 17*c* and on an outer surface of the top and left corner of the second boom 7*b*. By adjusting a position of the adjusting bolt 17*c* in its axial direction, the shoe 17*e* can properly abut on the outer surface of the corner of the second boom 7*b*.

The shoes 17*e* of the respective shoe units 17-1 abut on the outer surfaces of the second boom 7*b* as discussed above. The metal members 17*a* of the respective shoe units 17-2 are fastened to the second boom 7*b* and the shoes 17*e* of the respective shoe units 17-2 abut on inner surfaces of the basal second boom 7*b*. The metal members 17*a* of the respective shoe units 17-3 are fastened to the second boom 7*b* and the shoes 17*e* of the respective shoe units 17-3 abut on outer surfaces of the third boom 7*c*. The metal members 17*a* of the respective shoe units 17-4 are fastened to the third boom 7*b* and the shoes 17*e* of the respective shoe units 17-3 abut on inner surfaces of the second boom 7*b*.

In this embodiment, as shown in FIG. 6, an auxiliary shoe unit 17-5 is further disposed at a bottom side of the basal boom 7*a*. The auxiliary shoe unit 17-5 is located at the front end of the basal boom 7*a* on the same circumferential line as the set of the shoe units 17-1.

Similarly to other shoe units 17-1, 17-2, 17-3, 17-4, the shoe unit 17-5 includes a shoe holder 17*d* and a shoe 17*e*. The shoe unit 17-5, however, has a pair of adjusting bolts 17*c* spaced apart from each other in the transverse direction of the working machine 1. A pair of cylindrical members extends through the bottom side of the basal boom 7*a* to be welded thereto. Each cylindrical member has a female thread inside thereof. The adjusting bolts 17*c* are screwed into the respective cylindrical members. By adjusting positions of the respective adjusting bolts 17*c* in the vertical direction (axial direction of each adjusting bolt 17*c*), the shoe 17*e* can properly abut on a bottom surface of the bottom side of the basal boom 7*a* via the shoe holder 17*d*. Because the shoe unit 17-5 increases the support force of the basal boom 7*a* for supporting the second boom 7*b*, downward flexure of the second boom 7*c* can be properly avoided.

Continuously referring to FIGS. 4-6, the drive mechanism 20 for extending and retracting the respective booms 7*a*, 7*b*, 7*c* of the boom unit 7 is described below.

The drive mechanism 20 preferably includes a primary drive unit 20-1 for extending and retracting the second boom 7*b* relative to the basal boom 7*a*, and a secondary drive unit 20-2 for extending and retracting the third boom 7*c* relative to the second boom 7*a*.

The primary drive unit 20-1 in this embodiment includes a rack and pinion mechanism. More specifically, a pair of fixed racks (first rack) 21 is fixed to an inner surface of the basal boom 7*a*. The fixed racks 21 extend parallel to each other along the longitudinal axis of the basal boom 7*a*. A pair of movable racks (second rack) 22 is fixed to an outer surface of the second boom 7*b* to be movable with the second boom 7*b* relative to the fixed racks 21. The movable racks 22 extend parallel to each other along the longitudinal axis of the second boom 7*b*.

As shown in FIG. 6, the respective fixed racks 21 are spaced apart from each other in the transverse direction of the working machine 1, while the respective movable racks 22 are spaced apart from each other in the same direction. A distance between the respective fixed racks 21 is larger than a distance between the respective movable racks 22, and the movable racks 22 are placed within the distance between the respective fixed racks 21.

A pinion unit 23 is interposed between the respective racks 21, 22. More specifically, two small pinions 23*a* and two large pinions 23*b* are coupled with each other by a coupling shaft 24 to form the pinion unit 23. The small pinions 23*a* are disposed on both of lateral sides of the respective large pinions 23*b* so that the small pinions 23*a* mesh with the fixed racks 21 and the large pinions 23*b* mesh with the movable racks 22. In other words, the large pinions 23*b* are nested in a space formed between the small pinions 23*a*. Consequently, the racks 21, 22 and the pinions 23*a*, 23*b* are symmetrically arranged in the rear view of FIG. 6. Because of this symmetrical arrangement, the second boom 7*b* is movable under a stable condition relative to the basal boom 7*a*.

In this embodiment, a gear ratio of each large pinion 23*b* to the associated small pinion 23*a* is decided to be twice whereby an extending and retracting stroke of the second boom 7*b* can be three times of a movement stroke of the pinion unit 23.

The primary drive unit 20-1 preferably has a cylinder device 25 for driving the pinion unit 23 along the racks 21, 22. The cylinder device 25 is typically structured as the hydraulically operable device described above, excepting a coupling member 26. That is, the cylinder device 25 has a cylinder 25*a*, a piston reciprocally movable within the cylinder 25*a*, a piston rod 25*b* extending from the piston to be out of the cylinder 25*a* and the coupling member 26. The coupling member 26 is a rigid member. A rear end of the coupling member 26 is fixed to the cylinder 25*a*. The coupling member 26 extends forwardly from the cylinder 25*a*. The coupling member 26 couples the cylinder 25*a* with the coupling shaft 24 (FIG. 6) of the pinion unit 23. On the other hand, a bracket 27 depends from the inner surface of the basal boom 7*a* in the rear of the fixed racks 21. A distal end of the piston rod 25*b* is fixed to the bracket 27. That is, the piston rod 25*b* is attached to the basal boom 7*a* through the bracket 27.

As shown in FIG. 4, when the piston rod 25*b* is fully positioned out of the cylinder 25*a*, the pinion unit 23 is placed at the most-rearward position to be adjacent to the bracket 27. The cylinder 25*a* is placed at the most-rearward position to be spaced apart from the bracket 27 to the maximum. The second boom 7*b* thus is fully positioned within the basal boom 7*a*.

On the other hand, as shown in FIG. 5, when the piston rod 25*b* is fully positioned within the cylinder 25*a*, the pinion unit 23 is placed at the most-forward position to be spaced apart from the bracket 27 to the maximum. The cylinder 25*a* is placed at the most-forward position to be adjacent to the bracket 27. The second boom 7*b* thus is fully positioned out of the basal boom 7*a*.

Because of the combinations of the small and large pinions 23*a*, 23*b* with the fixed and movable racks 21, 22, respectively, the second boom 7*b* can move in a long distance relative to a distance of the movement of the pinion unit 23 (i.e., relative to a stroke of the piston rod of the cylinder device 25). Also, a speed of the movement of the second boom 7*b* is faster than a speed of the movement of the pinion unit 23 along the fixed rack 21.

The secondary drive unit 20-2 in this embodiment includes a sprocket and chain mechanism. More specifically, as shown in FIGS. 4 and 5, an advancing sprocket (first sprocket) 30 is fixed to a front end portion of the second boom 7*a* for rotation. A reversing sprocket (second sprocket) 31 is fixed to a rear end portion of the second boom 7*a* for rotation. An advancing chain (first chain) 32 is wound around the advancing sprocket 31. One end of the advancing chain 32 is fixed to a rear end portion 32*a* of the basal boom 7*a* and another end of the advancing chain 32 is fixed to a rear end portion 32*b* of the third boom 7*a*. A reversing chain (second chain) 33 is wound around the reversing sprocket 31. One end of the reversing chain 33 is fixed to a front end portion 33*a* of the basal boom 7*a* and another end of the reversing chain 33 is fixed to a front end portion 33*b* of the third boom 33*b*.

Because of the arrangement discussed above, as shown in FIG. 5, tension force affecting the advancing chain 32 is generated along with the movement of the second boom 7*b* in the extended direction. The sprocket 30 rotates counterclockwise in the view of FIG. 5, and the length of the advancing chain 32 between the sprocket 30 and the rear end portion 32*a* of the basal boom 7*a* becomes longer. The third boom 7*c* thus is extended out of the second boom 7*b*. On the other hand, tension force affecting the reversing chain 33 is generated along with the movement of the second boom 7*b* in the retracted direction. The sprocket 31 rotates clockwise in the view of FIG. 5, and the length of the reversing chain 33 between the sprocket 31 and the forward end portion 33*a* of the basal boom 7*a* becomes shorter. The third boom 7*c* thus is retracted into the second boom 7*b*.

When the working machine 1 is carried by a truck or the like, the boom unit 7 is required to be portable, i.e., to be compact enough. In order to satisfy the compact requirement, as shown in FIG. 4, the piston rod 25*b* of the first drive unit 20-1 is fully out of the cylinder 25*a*. The pinion unit 23 thus is placed at the most-rearward position. The cylinder 25*a* is also placed at the most-rearward position. The second boom 7*b* is in the fully retracted position in the basal boom 7*a*. Under the condition, the third boom 7*c* is also fully retracted position in the second boom 7*b*.

When the working machine 1 reaches a working site, the boom unit 7 is extended to prepare for work such as, for example, collecting pieces of wood at the site. As shown in FIG. 5, the piston rod 25*b* is fully retracted into the cylinder 25*a*. The pinion unit 23 is moved to the most-forward position. Therefore, the second boom 7*b* is fully extended out of the basal boom 7*a*. Simultaneously, together with the movement of the second boom 7*b* in the extended direction, the advancing chain 32 advances the third boom 7*c* forward. The third boom 7*c* is also fully extended out of the second boom 7*b*, accordingly.

When the working machine finishes the work, the boom unit 23 is again brought to the retracted position shown in FIG. 4. The piston rod 25*b* is fully extended out of the cylinder 25*a*. The pinion unit 23 is moved to the most-rearward position. The second boom 7*b* thus is fully retracted into the basal boom 7*a*. Simultaneously, together with the movement of the second boom 7*b* in the retracted direction, the reversing chain 32 moves the third boom 7*c* rearward. The third boom 7*c* is fully retracted into the second boom 7*b*, accordingly.

Because the second boom 7*b* in this embodiment is retracted into the basal boom 7*a* when the piston rod 26 is extended out of the cylinder 25*a*, the second boom 7*b* can move more powerfully in the retracted direction than in the extended direction. This is because the cylinder device 25, i.e., the hydraulically operable device normally can generate larger power under the extended condition of the piston rod than under the retracted condition thereof. Therefore, the boom unit 7 can have much power under the condition that the boom unit 7 carries something such as, for example, pieces of wood toward the machine body 2 from the work place rather than under the condition that the boom unit 7 goes to the work place from the machine body 2 without having anything.

The secondary drive unit 20-2 in this embodiment is actuated by the primary drive unit 20-1. In other words, the movement of the third boom 7*c* is completely linked with the movement of the second boom 7*b*. The structure of the drive mechanism 20 as a whole is very simple, accordingly.

As thus discussed, in the illustrated embodiment, the basal boom 7*a* can pivot about the upper pivot pin P2 located at the mid portion of the basal boom 7*a* in the longitudinal direction of the basal boom 7*a* and positioned above the machine body 2. Therefore, the basal boom 7*a* can smoothly pivot about the axis of the upper pivot pin P2 in the vertical direction even though the rear portion of the basal boom 7*a* largely protrudes rearward from the upper pivot pin P2. That is, the basal boom 7*a* can be long enough, and the second and third booms 7*b*, 7*c* which are retractable into the basal boom 7*a* also can be sufficiently long. In addition, as indicated by the chain line of FIG. 1, the boom unit 7 inclines in front of the machine body 2 when the piston rod of the a boom pivoting cylinder device 13 is fully extracted and the piston rod of the support arm pivoting cylinder device 15 is fully retracted. Also, as indicated by the chain double-dashed line of FIG. 1, the boom unit 7 extends upward above the machine body 2 when the piston rod of the a boom pivoting cylinder device 13 is fully retracted and the piston rod of the support arm pivoting cylinder device 15 is fully extracted. The working machine 1 thus can have a large work area.

Also, because the rear portion of the basal boom 7*a* can extend rearward above the machine body 2 without being hindered by anything, the boom unit 7 can be compactly positioned above the machine body 2. Therefore, the working machine 1 is transportable without the boom unit 7 being detached from the machine body 2 of the working machine 1.

Figure 7:
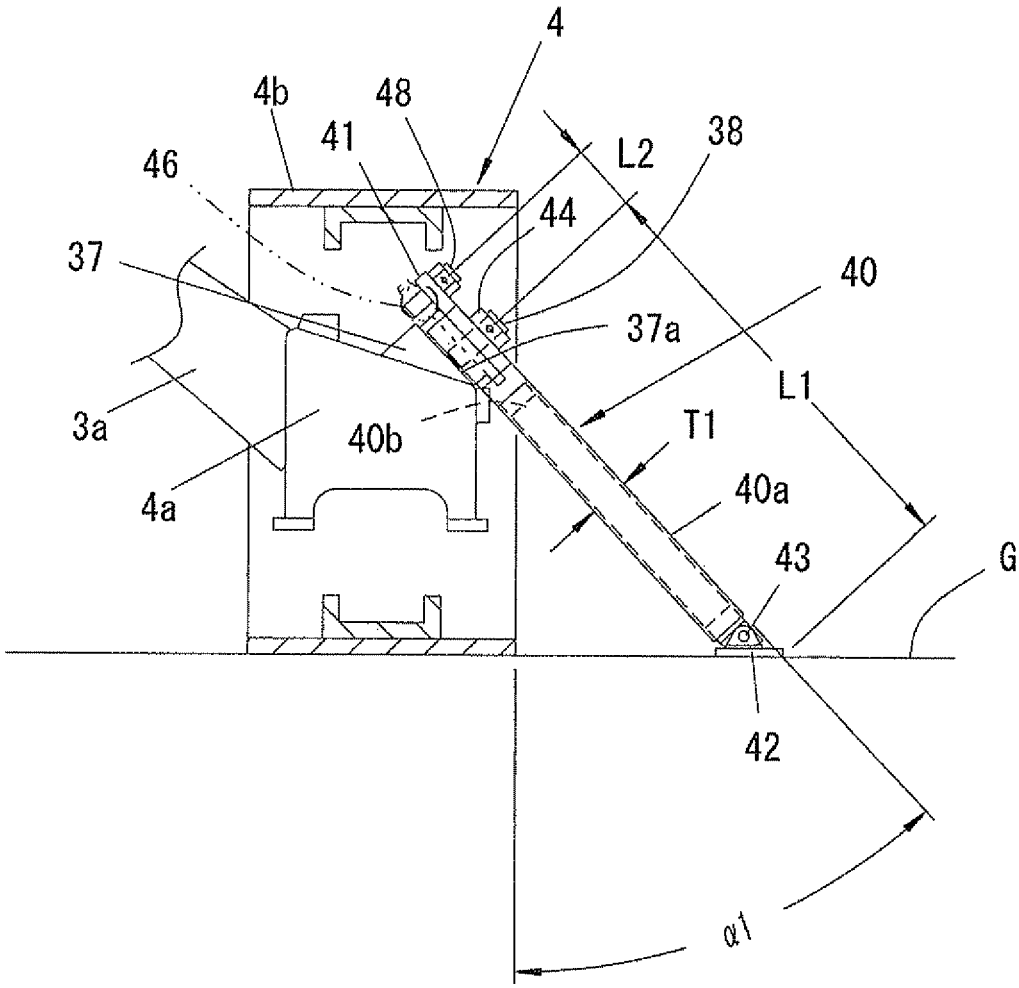
FIG. 7 illustrates an enlarged front elevational view of a part of the self-propelled working machine, particularly showing a leg thereof.
Figure 8:
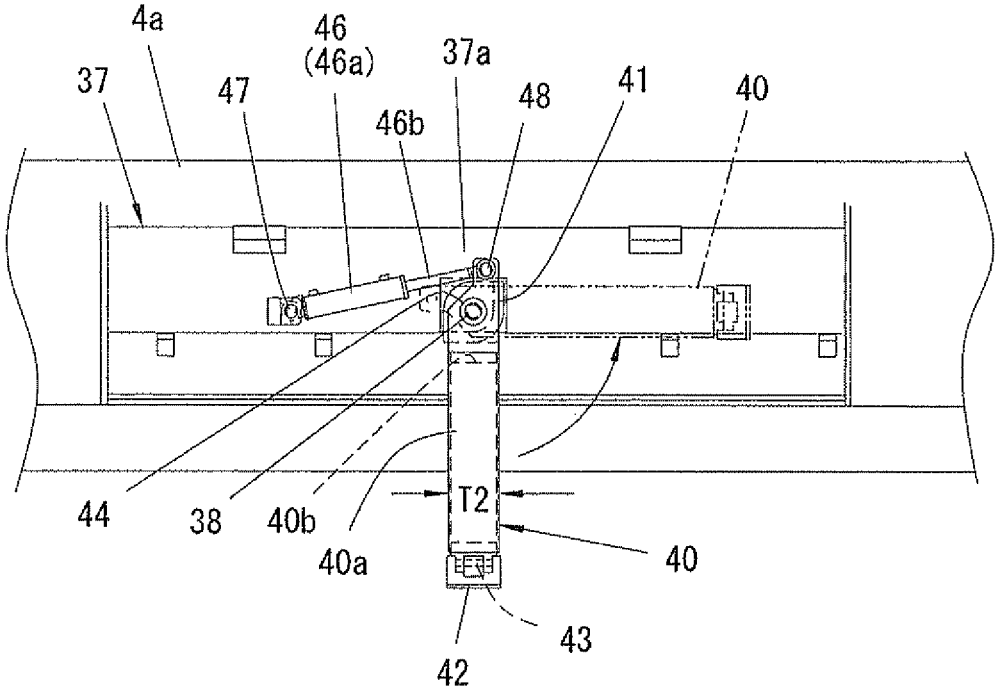
FIG. 8 illustrates an enlarged side elevational view of the part of the self-propelled working machine, particularly showing the leg thereof.

With reference to FIGS. 3, 7 and 8, the side occasional legs 40 are described in greater detail below.

As shown in FIG. 3, the side occasional legs 40 are provided on both lateral sides of the frame 3 to mainly receive a load of the major part of the working machine 1 other than the front part thereof. As shown in FIGS. 7 and 8, each side occasional leg 40 is fixed to the respective track frame 4*a* for pivotal movement about an axis of a pivot pin 38.

More specifically, as shown in FIG. 7, each track frame 4*a* has a top surface obliquely extending downward outward. A holder 37 is attached to the track frame 4*a* in a middle portion thereof. Preferably, the holder 37 is rigidly welded to the top surface of the track frame 4*a* or fastened thereto by bolts. The holder 37 is elongated in the fore to aft direction of the working machine 1 as shown in FIG. 8 and generally has a triangle shape in the front view of FIG. 7. The side occasional leg 40 is fixed to a mid portion of the holder 37 in the fore to aft direction. Because of the triangle shape, a top surface of the holder 37 slants downward outward more than the top surface of the track frame 4*a*. The axis of the pivot pin 38 generally extends normal to the top surface of the holder 37. Accordingly, the axis of the pivot pin 38 extends from the holder 37 obliquely downward outward relative to a horizontal plane (for example, the ground surface G of FIG. 7).

In this embodiment, a length of the holder 37 in the fore to aft direction is approximately 2400 mm. A slant angle $\alpha$1 of the top surface of the holder 37 relative to the horizontal plane is approximately 43°.

A top end of the pivot pin 38 has a male screw. The side occasional leg 40 is pivotally put onto to the pivot pin 38 just below the male screw. A nut 44 is screwed onto the male screw to prevent the occasional leg 40 from falling out from the pivot pin 38.

Each side occasional leg 40 is preferably formed with an outer metallic tube 40*a* and an inner metallic tube 40*b*. Each tube 40*a*, 40*b* has a rectangular shape in section. The inner tube 40*b* is telescopically inserted into the outer tube 40*a*. The inner tube 40*b* is extendable from and retractable into the outer tube 40*a* within a range of approximately 130 mm. A bracket 41 is unitarily fixed to a top end of the outer tube 40*a*. The pivot pin 38 extends through the top end of the outer tube 40*a* and the bracket 41. A top end of the bracket 41 extends upward generally above the outer tube 40*a*. An end of a piston rod 46*b* of a leg cylinder device 46, which will be described in greater detail later, is fixed to the top end of the bracket 41 by a connecting pin 48 for pivotal movement about an axis of the connecting pin 48. A bottom end of the inner tube 40*b* has a contact pad 42 with which the inner tube 40*b* contacts the ground surface G. A pin 43 couples the contact pad 42 with the bottom end of the inner tube 40*b* for pivotal movement about an axis of the pin 43 extending in the fore to aft direction of the working machine 1.

In this embodiment, a distance L1 between the axis of the pivot pin 38 and the bottom end of the side occasional leg 40 is approximately 823 mm. A distance L2 between the axis of the connecting pin 48 and the axis of the pivot pin 38 is approximately 125 mm. The illustrated outer tube 35*a* is a rectangular parallelepiped member whose thickness T1 is approximately 75 mm and whose width T2 is approximately 150 mm. Alternatively, the outer and inner tubes 40*a*, 40*b* can be cylindrical pipe members.

The aforenoted leg cylinder device 46 pivotally moves each side occasional leg 40. The leg cylinder device 46 is the hydraulically operable device. As shown in FIG. 8, the leg cylinder device 46 generally extends along the top surface 37*a* of the holder 37 in the fore to aft direction of the working machine 1. An end of a cylinder 46*a* of the leg cylinder device 46, which is positioned opposite to the piston rod 46*b*, is coupled with a front portion of the holder 37 by a connecting pin 47 for pivotal movement, while the end of the piston rod 46*b* of the leg cylinder device 46 is fixed to the top end of the bracket 41 by the connecting pin 48 for pivotal movement about the axis of the connecting pin 48.

As indicated by the actual lines of FIGS. 7 and 8, each side occasional leg 40 is pivoted downward about the axis of the pivot pin 38 when the piston rod 46*b* of the associated leg cylinder device 46 is extended. The occasional leg 40 protrudes outward to be out of the crawler shoe 4*b* so that the contact pad 42 reaches the ground surface G to abut thereon. On the other hand, as indicated by the phantom line of FIG. 8, each side occasional leg 40 is pivoted upward rearward about the axis of the pivot pin 38 when the piston rod 46*b* of the associated leg cylinder device 46 is retracted. The occasional leg 40 extends along the top surface 37*a* of the holder 37 in the fore to aft direction of the working machine 1 to be housed in a space defined under the crawler shoe 4*b*. That is, each side occasional leg 40 is pivotable between the retracted position in which the leg 40 extends along the holder 37 and the extended position in which the leg 40 contacts the ground surface.

The illustrated side occasional legs 40 are particularly useful to support the working machine 1 against the loads affecting the working machine 1 in the transverse direction thereof. Also, because the side occasional legs 40 can be housed under the crawler shoe 4*b* when the legs 40 are not needed, the working machine 1 can move around without any interruption. The working machine 1 thus can be normally equipped with the legs 40.

Alternatively, a plurality of side occasional legs 40 can be provided to the frame arm 4*a* on one side. Preferably, such occasional legs 40 are spaced apart from each other in the fore to aft direction of the working machine 1.

With reference to FIGS. 3 and 9-13, a gravity center lowering unit 50 is described below.

Figure 9:
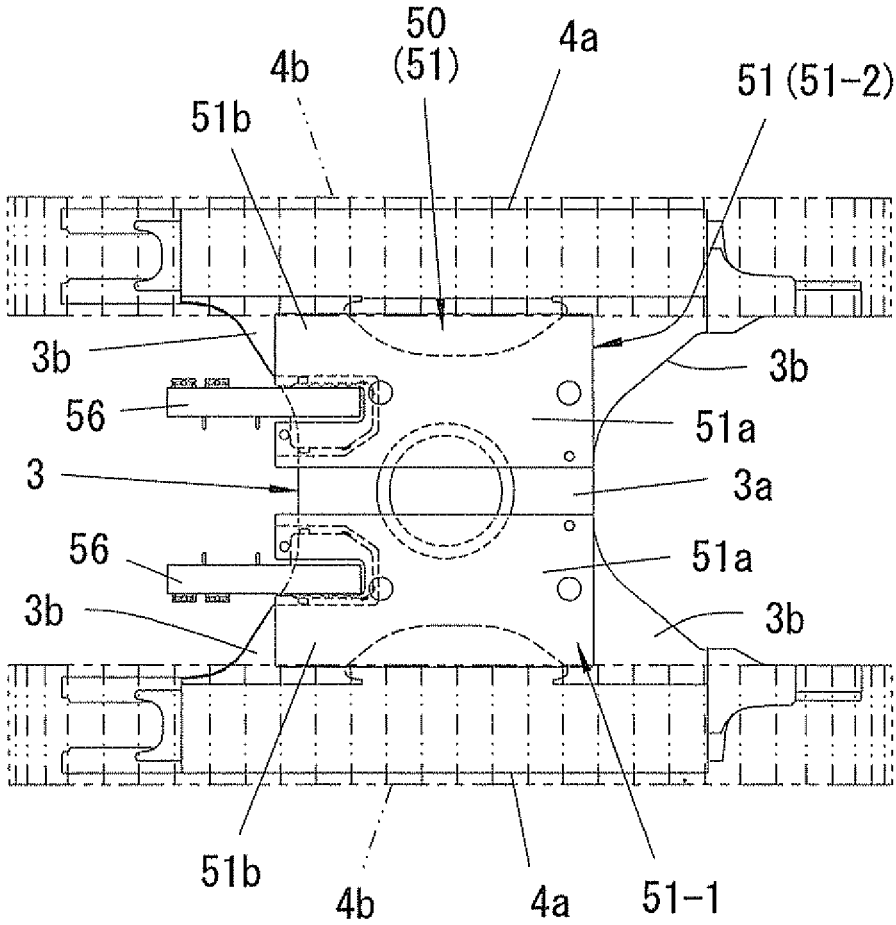
FIG. 9 illustrates a bottom plan view of a major part of the self-propelled working machine.

As shown in FIGS. 3 and 9, the gravity center lowering unit 50 in this embodiment is a weight unit 51 attached to a bottom surface of the frame 3. The weight unit 51 includes two weights 51-1, 51-2 disposed separately on the right and left hand sides of the bottom surface of the frame 3 and detachably attached thereto by fastening units 52 such as, for example, bolts and nuts. The weights 51-1, 51-2 are symmetrically formed and arranged relative to a vertical center plane of the frame 3 extending in the fore to aft direction of the working machine 1. Each weight 51-1, 51-2 is preferably made of metal, and is made of cast iron (FCD400) in this embodiment. As shown in FIG. 3, each weight 51-1, 51-2 is formed with an inner half 51*a* extending horizontally along a bottom portion of the main frame 3*a* and an outer half 51*b* extending downward outward along a bottom portion of the frame arm 3*b*. In this embodiment, each weight 51-1, 51-2 weighs approximately 500 kg.

Figure 10:
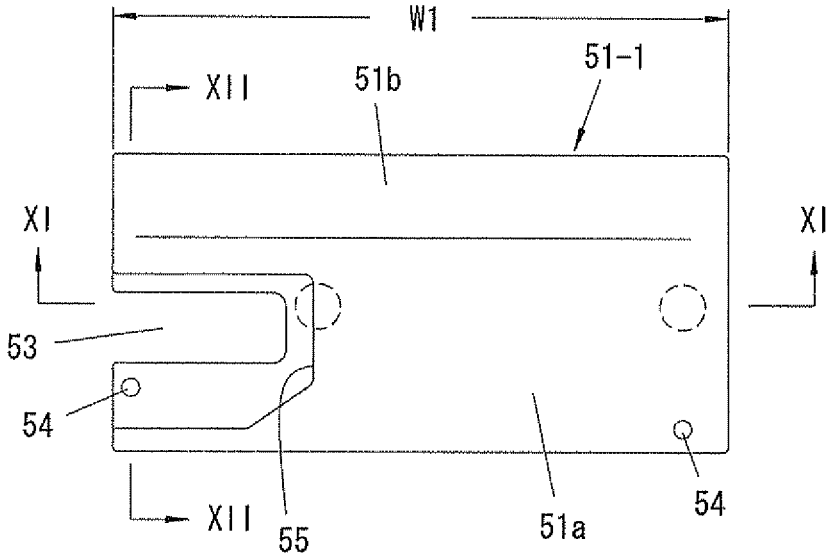
FIG. 10 illustrates a top plan view of one of weights.
Figure 11:
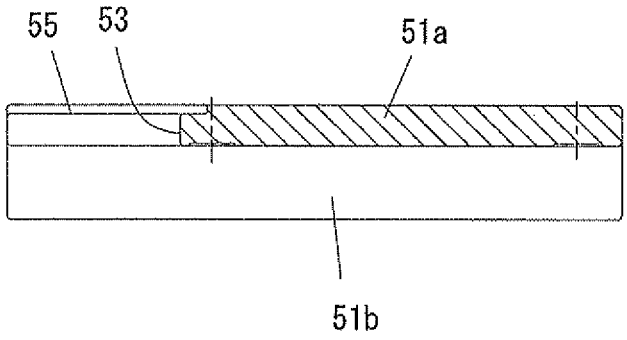
FIG. 11 illustrates a cross-sectional view of the weight taken along the line XI-XI of FIG. 10.
Figure 12:
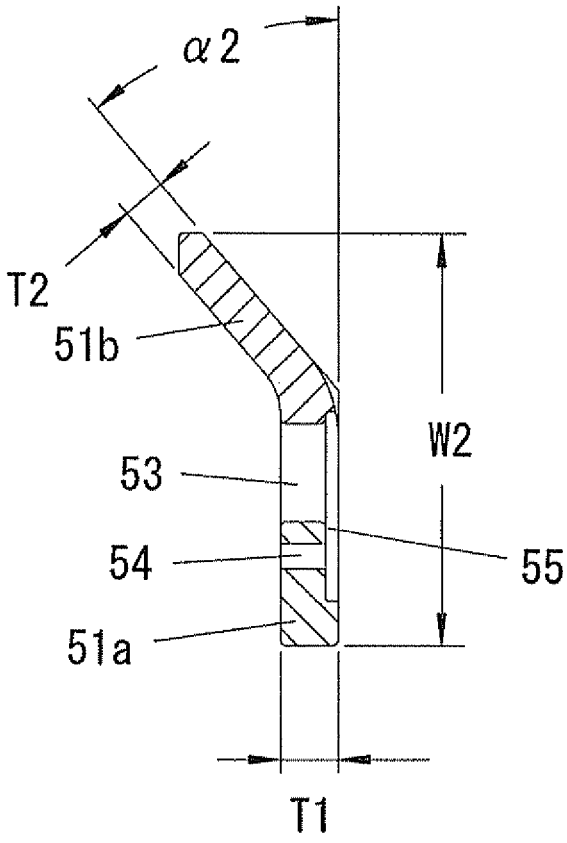
FIG. 12 illustrates another cross-sectional view of the weight taken along the line XII-XII of FIG. 10.

With reference to FIGS. 10-12, the weight 51-1 disposed on the left hand side is described below because the weight 51-2 has the same structure as the weight 51-1, excepting that the respective weights 51-1, 51-2 are symmetrical relative to the vertical center plane.

The weight 51-1 generally has a rectangular shape in a top plan view. In the illustrated embodiment, a length W1 (FIG. 10) in the fore to aft direction of the working machine 1 is approximately 1350 mm and a length W2 (FIG. 12) in the transverse direction thereof is approximately 650 mm. A thickness T1 (FIG. 12) of the inner half 51*a* is approximately 90 mm and a thickness T2 (FIG. 12) of the outer half 51*b* is approximately 70 mm. A curved angle $\alpha$2 (FIG. 12) made between the inner half 51*a* and the outer half 51*b* is approximately 40.6°. The curved angle $\alpha$2 corresponds to a curved angle made between the main frame 3*a* and the frame arm 3*b*.

A front end portion of the inner half 51*a* has a U-shaped notch 53 in which an attachment bracket 56 (FIGS. 3 and 9) can be nested. The attachment bracket 56 is fixed to the frame 3. An attachment detachably attached to both of the brackets 56 is, for example, a scraper. Bolt holes 54 (FIG. 10) are pierced at front and rear ends of an inner portion of the inner half 51*a*. A recess 55 is formed around the U-shaped notch 53 in which a base portion of the attachment bracket 56 is housed. A material, a configuration, a weight, dimensions of respective portions, etc. of the weight unit 51 can be properly decided based upon a sort of the working machine, an object of work, etc.

Because the weight unit 51 is attached to the bottom surface of the frame 3, the center of gravity of the working machine 1 is lowered. Therefore, the working machine 1 is stable and is effectively prevented from falling down under work conditions. Particularly, the weight unit 51 is effective against the sideways fall down of the working machine 1.

Also, the weight unit 51 can contribute to inhibiting an excessive load from being generated at bearings which pivotally support the machine body 2. Pivot performance and durability of the machine body 2 thus can be enhanced.

Because the weight unit 51 is divided into multiple portions (two portions in this embodiment), each weight 51-1, 51-2 can have a simple shape even though the bottom surface of the frame 3 is curved or bent.

Figure 13:
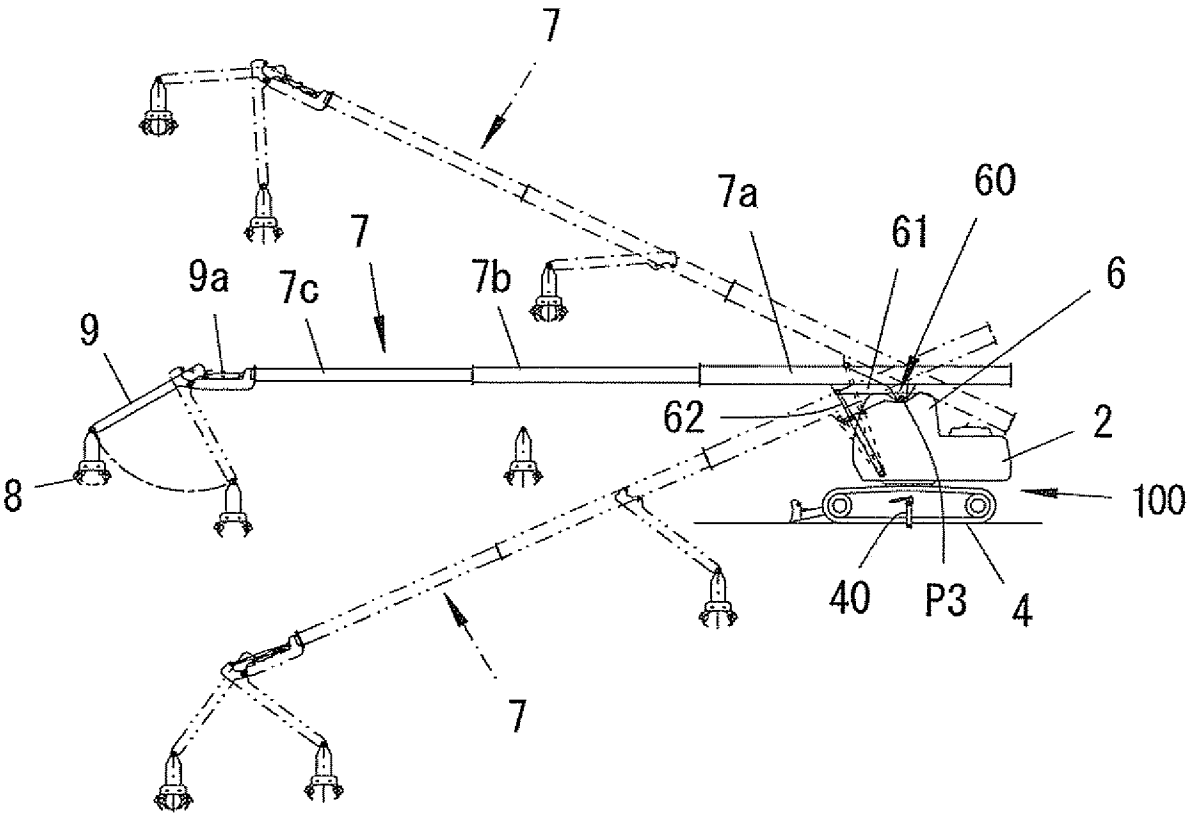
FIG. 13 illustrates a side elevational view of a modified self-propelled working machine configured in accordance with a second embodiment of the present invention, showing various operating conditions of a boom unit and other relating components of the self-propelled working machine.
Figure 14:
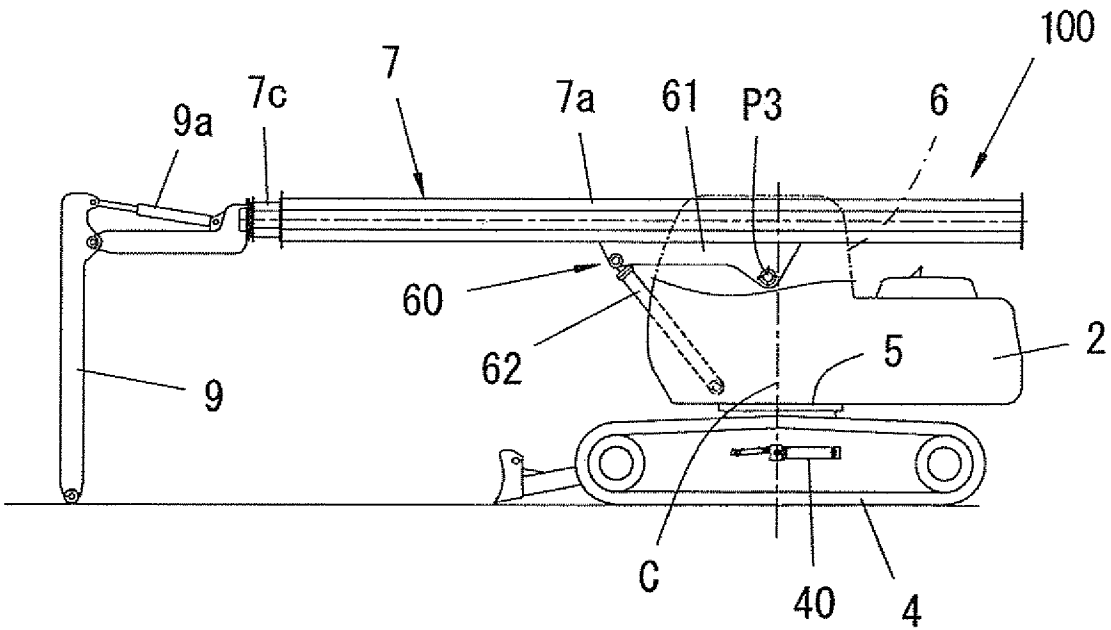
FIG. 14 illustrates another elevational view of the self-propelled working machine of the second embodiment, showing a fully retracted condition of the boom unit and the other relating components.
Figure 15:
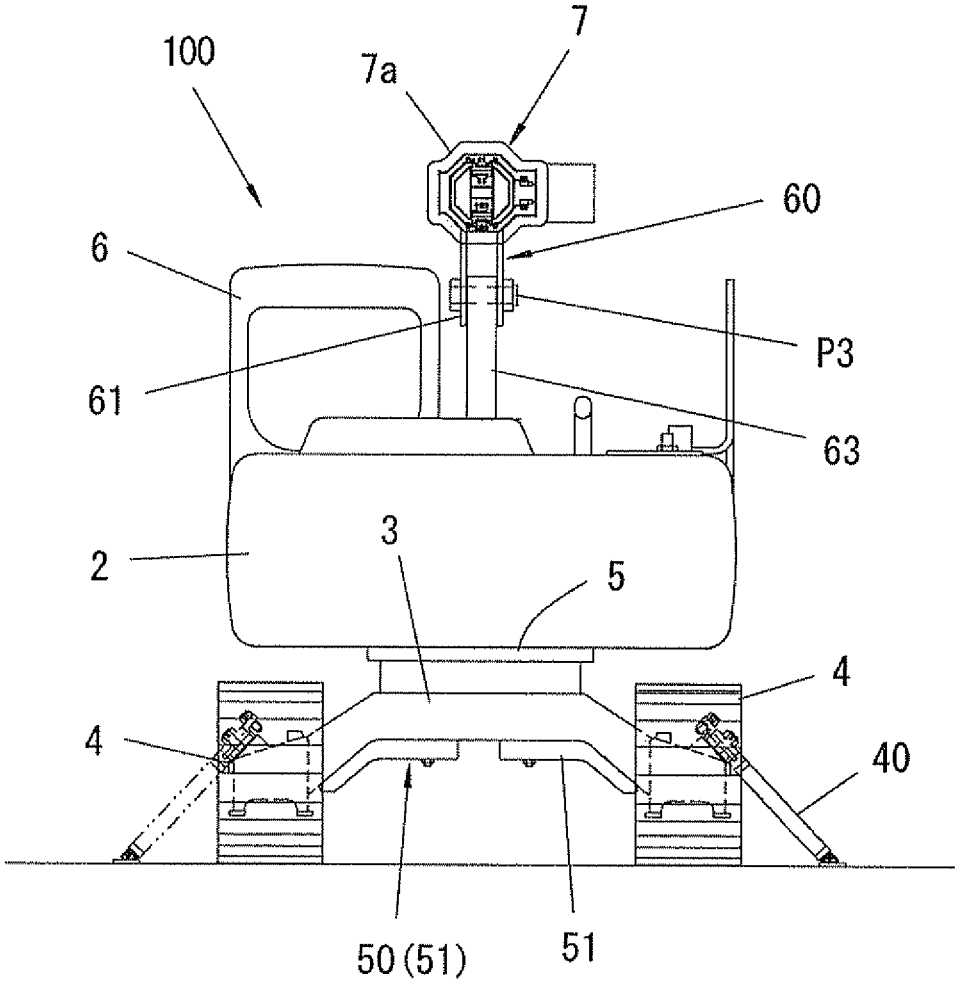
FIG. 15 illustrates a rear view of the self-propelled working machine of the second embodiment.

With reference to FIGS. 13-15, a self-propelled working machine 100 modified in accordance with a second embodiment of the present invention is described below.

The working machine 100 in this embodiment has a machine body 2, a drive tracks (crawlers), a cockpit 6, a boom unit 7 and side occasional legs 40. Similarly to the above embodiment, the boom unit 7 includes a basal boom 7*a*, a second boom 7*b* and a third boom 7*c*. The third boom 7*c* has an arm 9 which is pivoted by an arm cylinder device 9*a*. An attachment 8 such as, for example, a clamshell bucket is attached to a top end of the arm 9.

A support system 60 is disposed on a machine body 2 to support the boom unit 7 for pivotal movement. The support device 60 includes a boom bracket 61, a boom pivoting cylinder device 62, a boom support 63 (FIG. 15), etc. That is, the boom bracket 61 is fixed to a mid portion of the basal boom 7*a* in a longitudinal direction of the basal boom 7*a*. The boom support 63, which is a rectangular-parallelepiped shape, is fixed to a center portion of the machine body 2 to extend generally upward. The center portion is close to a pivot axis C of the machine body 2. A rear end of the boom bracket 61 fits over a top end of the boom support 63. An upper pivot pin P3 formed with a bolt is inserted into an opening made at a fitting section of the boom bracket 61. The opening is defined in a transverse direction of the working machine 100. A nut is screwed onto an end of the upper pivot pin (bolt) P3. The rear end of the boom bracket 61 thus is coupled with the top end of the boom support 63 for pivotal movement. As shown in FIG. 15, the upper pivot pin P3 is positioned at the same level as a top end of the cockpit 6 or slightly above the cock pit 6.

As shown in FIGS. 13 and 14, the boom bracket 61 is elongated in the longitudinal direction of the basal boom 7*a*. A top end of a piston rod of the boom pivoting cylinder device 62 is coupled with a front end of the boom bracket 61, while a bottom end of a cylinder of the boom pivoting cylinder device 62 is coupled with the machine body 2. As thus constructed, the basal boom 7*a* can pivot about an axis of the upper support pin P3 when the boom pivoting cylinder device 62 is activated.

According to this modified embodiment, the basal boom 7*a* can smoothly pivot about the axis of the upper pivot pin P3 in a vertical direction, even though a rear portion of the basal boom 7*a* largely protrudes rearward from the upper pivot pin P3, similarly to the above embodiment.

The center of gravity of the working machine 100 is moved rearward because of the position of the upper pivot pin P3. Therefore, the working machine 100 can operate under a stable condition with the boom unit 7 fully extended forward. Also, the second and third booms 7*b*, 7*c* can be elongated to increase the total length of the boom unit 7.

When, as shown in FIG. 14, the boom unit 7 is fully retracted and is laid down onto the machine body 2 to extend generally horizontally and the arm 9 is pivoted downward, the arm 9 does not protrude so much relative to the machine body 2. In addition, the arm itself can support the working machine 100 through the boom unit 7. The working machine 100 can be easily transported by a truck or the like.

Although this invention has been disclosed in the context of a certain preferred embodiment, it will be understood by those skilled in the art that the present invention extends beyond the specifically disclosed embodiments to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

The invention claimed is:

1. A working machine comprising:

a frame;

a drive section mounted to the frame for contacting a ground surface, rotation of a portion of the drive section enabling forward and rearward movement of the frame relative to the ground surface;

a body section mounted to the frame for pivotal movement generally about a vertical axis which extends generally vertically, the body section at least including a prime mover for powering the drive section;

a boom unit having a plurality of booms telescopically extendable from and retractable to one another;

a support arm mounted to the body section for pivotal movement about a first horizontal axis which extends generally horizontally, an end of the support arm being coupled with a basal boom which is one of the booms, the basal boom being pivotable relative to the support arm about a second horizontal axis which extends generally horizontally;

a first hydraulically operable device having a piston rod connected to the basal boom for pivoting the basal boom relative to the support arm about the second horizontal axis;

a guide rail fixed to the basal boom and extending along the longitudinal axis of the boom unit;

a bracket movably received in the guide rail and extending along a longitudinal axis of the boom unit; and wherein the bracket has a first pin through which the basal boom is coupled to the support arm for pivotal movement about the second horizontal axis; and wherein the bracket is movable along the guide rail and fixable at a rear location and at a front location such that the basal boom projects further forward relative to the body section when the bracket is located in the rear location than when the bracket is located in the front location.

2. The working machine according to claim 1, wherein the bracket has a second pin spaced apart from the first pin along the longitudinal axis of the basal boom, the second pin has a third horizontal axis which generally horizontally extends, and an end of the piston rod of the first hydraulically operable devices is coupled with the bracket for pivotal movement about the third horizontal axis of the second pin.

3. The working machine according to claim 1 further comprising a second hydraulically operable device extending from the body section to the support arm for pivoting the support arm generally vertically relative to the body section.

4. The working machine according to claim 1 further comprising a primary drive unit moves a second boom of the boom unit, which is positioned next to the basal boom, relative to the basal boom, and a secondary drive unit moves a third boom of the boom unit, which is positioned next to the second boom and opposite to the basal boom, relative to the second boom, and the secondary drive unit drives the third boom generally simultaneously when the primary drive unit moves the second boom.

5. The working machine according to claim 4, wherein the primary drive unit includes a rack and pinion mechanism.

6. The working machine according to claim 5, wherein the rack and pinion mechanism includes a first rack fixed to an inner surface of the basal boom and extending along the longitudinal axis of the basal boom, a second rack fixed to an outer surface of the second boom and extending along the longitudinal axis of the second boom, a pinion interposed between the first and second racks for meshing with the first and second racks, and a second hydraulically operable device, a first portion of the second hydraulically operable device is coupled with the basal boom and a second portion thereof is coupled with the pinion to move the pinion along the first and second racks.

7. The working machine according to claim 6, wherein the second hydraulically operable device comprises a cylinder, a piston reciprocally movable within the cylinder, and a piston rod extending from the piston to be out of the cylinder, and the piston rod is the first portion and the cylinder is the second portion.

8. The working machine according to claim 6, wherein the pinion includes a small diameter pinion section and a large diameter pinion section both of which are coaxially coupled with each other.

9. The working machine according to claim 4, wherein the secondary drive unit includes a sprocket and chain mechanism.

10. The working machine according to claim 9, wherein the sprocket and chain mechanism includes a first sprocket rotatably fixed to a front end portion of the second boom, a second sprocket rotatably fixed to a rear end portion of the second boom, a first chain wound around the first sprocket, one end of the first chain being fixed to a rear portion of the basal boom and another end of the first chain being fixed to a rear portion of the third boom, and a second chain wound around the second sprocket, one end of the second chain being fixed to a front portion of the basal boom and another end of the second chain being fixed to a front portion of the third boom.

11. The working machine according to claim 1 further comprising a leg fixed to the frame for pivotal movement about an axis extending from the frame obliquely downward outward relative to a horizontal plane, and the leg is pivotable between a retracted position in which the leg extends along the frame and a extended position in which the leg is adapted to contact the ground surface.

12. The working machine according to claim 11 further comprising a hydraulically operable device for pivoting the leg between the retracted and extended positions.

13. The working machine according to claim 1 further comprising a solid weight detachably attached to a bottom surface of the frame and expanding over at least an area of the bottom surface.

14. The working machine according to claim 13, wherein the solid weight is divided into a plurality of weight sections to be attached the bottom surface of the frame.

15. A working machine comprising:

a frame;

a drive section mounted to the frame for contacting a ground surface, rotation of a portion of the drive section enabling forward and rearward movement of the frame relative to the ground surface;

a body section mounted to the frame for pivotal movement generally about a vertical axis which extends generally vertically, the body section at least including a prime mover for powering the drive section;

a boom unit having a plurality of booms telescopically extendable from and retractable to one another, one of the booms being a basal boom acting as a base for the telescopic movement;

a guide fixed to the basal boom and extending along a longitudinal axis of the boom unit;

a bracket movable along the guide;

a support arm mounted to the body section for pivotal movement about a first horizontal axis which extends generally horizontally, an end of the support arm being coupled with the bracket, the bracket being pivotable relative to the support arm about a second horizontal axis which extends generally horizontally; and a first hydraulically operable device extending from the body section to the bracket for pivoting the bracket relative to the support arm about the second horizontal axis;

wherein the basal boom has a guide rail extending along the longitudinal axis of the boom unit; and wherein the bracket is movable along the guide rail and fixable at a rear location and at a front location so that the basal boom projects further forward relative to the body section when the bracket is located in the rear location than when the bracket is located in the front position.

16. The working machine according to claim 15, wherein the support arm and the first hydraulically operable device are coupled with the bracket at respective positions which are spaced apart from each other.

17. The working machine according to claim 15 further comprising a second hydraulically operable device extending from the body section to the support arm for pivoting the support arm generally vertically relative to the body section.

* * * * *